US009989280B2

(12) United States Patent
Ali

(10) Patent No.: US 9,989,280 B2
(45) Date of Patent: Jun. 5, 2018

(54) CASCADE COOLING SYSTEM WITH INTERCYCLE COOLING OR ADDITIONAL VAPOR CONDENSATION CYCLE

(75) Inventor: Masood M. Ali, Hatchechubbee, AL (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 873 days.

(21) Appl. No.: 12/290,434

(22) Filed: Oct. 30, 2008

(65) Prior Publication Data

US 2009/0272128 A1 Nov. 5, 2009

Related U.S. Application Data

(60) Provisional application No. 61/126,276, filed on May 2, 2008.

(51) Int. Cl.

| | |
|---|---|
| ***F25B 7/00*** | (2006.01) |
| ***F25B 5/02*** | (2006.01) |
| *F25B 40/00* | (2006.01) |

(52) U.S. Cl.

CPC ..... *F25B 7/00* (2013.01); *F25B 5/02* (2013.01); *F25B 40/00* (2013.01); *F25B 2313/0233* (2013.01); *F25B 2400/04* (2013.01); *F25B 2400/0401* (2013.01); *F25B 2500/06* (2013.01)

(58) Field of Classification Search

CPC ..... F25B 7/00; F25B 2313/02321; F25B 2400/0401; F25B 25/005; F25B 2313/02331; F25B 5/00; F25B 5/02; F25B 2400/04

USPC ... 62/335, 333, 509, 117, 175, 196.3, 196.1; 165/205, 207

See application file for complete search history.

(56) References Cited

U.S. PATENT DOCUMENTS

| | | | | |
|---|---|---|---|---|
| 1,519,353 | A | 12/1924 | Bowen et al. | |
| 2,195,228 | A | 3/1940 | Schwarz | |
| RE21,599 | E | 10/1940 | Schwarz | |
| RE21,600 | E | 10/1940 | Schwarz | |
| 2,234,372 | A | 3/1941 | Friedman | |
| 2,680,956 | A * | 6/1954 | Haas | 62/175 |
| 2,719,409 | A | 10/1955 | Rayburn | |
| 3,092,976 | A | 6/1963 | Hashemi-Tafreshi | |
| 3,392,541 | A * | 7/1968 | Nussbaum | 62/175 |
| 3,872,682 | A | 3/1975 | Shook | 62/114 |
| 3,893,307 | A * | 7/1975 | Jacobs | 62/150 |
| 3,992,171 | A * | 11/1976 | Jenewein | 62/419 |
| 4,205,532 | A | 6/1980 | Brenan | 62/115 |
| 4,764,193 | A * | 8/1988 | Clawson | 62/3.3 |
| 4,972,683 | A * | 11/1990 | Beatenbough | 62/507 |

(Continued)

OTHER PUBLICATIONS

Klaas Visser, "Carbon Dioxide (CO2) For the Food Processing and Cold Storage Industries," The Official Journal of Airah, Jun. 2002, pp. 16-21.

(Continued)

*Primary Examiner* — Orlando E Aviles Bosques
(74) *Attorney, Agent, or Firm* — Baker Botts L.L.P.

(57) ABSTRACT

A cascade refrigeration system comprising a first cycle for circulating a first refrigerant, a second cycle for circulating a second refrigerant and a heat exchanger. The first refrigerant and the second refrigerant are in thermal communication, and the second cycle includes a receiver that receives a liquid form of the second refrigerant from the heat exchanger.

9 Claims, 6 Drawing Sheets

(56) References Cited

U.S. PATENT DOCUMENTS

| | | | | |
|---|---|---|---|---|
| 5,245,836 | A | 9/1993 | Lorentzen et al. | 62/174 |
| 5,400,615 | A | 3/1995 | Pearson | 62/277 |
| 5,497,631 | A | 3/1996 | Lorentzen et al. | 62/115 |
| 5,655,378 | A | 8/1997 | Pettersen | 62/174 |
| 5,761,921 | A * | 6/1998 | Hori et al. | 62/238.4 |
| 6,000,233 | A | 12/1999 | Nishida et al. | 62/114 |
| 6,062,030 | A | 5/2000 | Viegas | 62/175 |
| 6,085,544 | A | 7/2000 | Sonnekalb et al. | 62/498 |
| 6,112,532 | A | 9/2000 | Bakken | 62/174 |
| 6,311,507 | B1 * | 11/2001 | Gameiro | 62/196.4 |
| 6,418,735 | B1 | 7/2002 | Sienel | 62/115 |
| 6,427,479 | B1 | 8/2002 | Komatsubara et al. | 62/503 |
| 6,457,325 | B1 | 10/2002 | Vetter | 62/473 |
| 6,502,412 | B1 | 1/2003 | Dube | 62/175 |
| 6,519,967 | B1 * | 2/2003 | Mosemann et al. | 62/335 |
| 6,557,361 | B1 | 5/2003 | Howard | 62/175 |
| 6,568,199 | B1 | 5/2003 | Manohar | 62/223 |
| 6,595,009 | B1 * | 7/2003 | Howard et al. | 62/79 |
| 6,606,867 | B1 | 8/2003 | Sienel | 62/113 |
| 6,627,309 | B2 | 9/2003 | Stebbings et al. | 428/352 |
| 6,647,742 | B1 | 11/2003 | Neiter et al. | 62/498 |
| 6,658,888 | B2 | 12/2003 | Manohar et al. | 62/498 |
| 6,694,763 | B2 | 2/2004 | Howard | 62/228.3 |
| 6,698,214 | B2 | 3/2004 | Chordia | 62/114 |
| 6,698,234 | B2 | 3/2004 | Gopalnarayanan et al. | 62/505 |
| 6,739,141 | B1 | 5/2004 | Sienel et al. | 62/87 |
| 6,751,966 | B2 | 6/2004 | Viegas et al. | 62/131 |
| 6,813,895 | B2 | 11/2004 | Eisenhower et al. | 62/115 |
| 6,848,268 | B1 | 2/2005 | Memory et al. | 62/513 |
| 6,898,941 | B2 | 5/2005 | Sienel | 62/87 |
| 6,920,919 | B2 | 7/2005 | Wilson et al. | 165/163 |
| 6,923,011 | B2 | 8/2005 | Manole | 62/149 |
| 6,925,821 | B2 | 8/2005 | Sienel | 62/149 |
| 6,931,866 | B2 * | 8/2005 | Sato et al. | 62/151 |
| 6,945,073 | B2 | 9/2005 | Matsumoto et al. | 62/470 |
| 6,962,059 | B2 | 11/2005 | Okaza et al. | 62/513 |
| 6,988,542 | B2 | 1/2006 | Hughes et al. | 165/164 |
| 7,000,413 | B2 | 2/2006 | Chen et al. | 62/225 |
| 7,013,664 | B2 | 3/2006 | Matsumoto et al. | 62/278 |
| 7,013,672 | B2 | 3/2006 | Matsumoto et al. | 62/470 |
| 7,024,883 | B2 | 4/2006 | Sienel et al. | 62/503 |
| 7,028,494 | B2 | 4/2006 | Pondicq-Cassou et al. | 62/196.4 |
| 7,051,542 | B2 | 5/2006 | Chen et al. | 62/160 |
| 7,051,551 | B2 | 5/2006 | Matsumoto et al. | 62/512 |
| 7,065,979 | B2 | 6/2006 | Arshansky et al. | 62/335 |
| 7,076,968 | B2 | 7/2006 | Matsumoto et al. | 62/470 |
| 7,082,785 | B2 | 8/2006 | Nieter et al. | 62/470 |
| 7,086,237 | B2 | 8/2006 | Arshansky et al. | 62/77 |
| 7,096,679 | B2 | 8/2006 | Manole | 62/115 |
| 7,101,162 | B2 | 9/2006 | Matsumoto et al. | 418/60 |
| 7,131,291 | B2 | 11/2006 | Aflekt et al. | 62/498 |
| 7,131,294 | B2 | 11/2006 | Manole | 62/513 |
| 7,178,362 | B2 | 2/2007 | Collings | 62/527 |
| 7,210,303 | B2 | 5/2007 | Zhang et al. | 62/183 |
| 7,216,498 | B2 | 5/2007 | Manole et al. | 62/208 |
| 7,220,110 | B2 | 5/2007 | Matsumoto et al. | 418/60 |
| 7,231,966 | B2 | 6/2007 | Katoh et al. | 165/176 |
| 7,302,807 | B2 | 12/2007 | Yakumaru et al. | 62/238.6 |
| 7,331,196 | B2 | 2/2008 | Itsuki et al. | 62/510 |
| 7,334,430 | B2 | 2/2008 | Kakehashi | 62/513 |
| 7,370,493 | B2 | 5/2008 | Suzuki et al. | 62/513 |
| 7,424,807 | B2 | 9/2008 | Sienel | 62/513 |
| 2004/0129015 | A1 * | 7/2004 | Apparao et al. | 62/335 |
| 2004/0148956 | A1 * | 8/2004 | Arshansky et al. | 62/335 |
| 2004/0250468 | A1 | 12/2004 | Deng et al. | 44/412 |
| 2005/0044885 | A1 | 3/2005 | Pearson | 62/512 |
| 2005/0120737 | A1 * | 6/2005 | Borror et al. | 62/434 |
| 2005/0127320 | A1 | 6/2005 | Fahl et al. | 252/68 |
| 2005/0252226 | A1 | 11/2005 | Seefeldt | 62/238.7 |
| 2005/0279127 | A1 | 12/2005 | Jia et al. | 62/510 |
| 2006/0086110 | A1 | 4/2006 | Manole | 62/175 |
| 2006/0123827 | A1 | 6/2006 | Achaichia | 62/333 |
| 2006/0137385 | A1 | 6/2006 | Take et al. | 62/498 |
| 2006/0144053 | A1 | 7/2006 | Zhang et al. | 62/6 |
| 2006/0168996 | A1 | 8/2006 | Imai et al. | 62/510 |
| 2006/0168997 | A1 | 8/2006 | Imai et al. | 62/513 |
| 2006/0201188 | A1 | 9/2006 | Kopko | 62/333 |
| 2006/0218948 | A1 | 10/2006 | Otake et al. | 62/160 |
| 2006/0230773 | A1 | 10/2006 | Park | 62/222 |
| 2006/0260354 | A1 | 11/2006 | Nakatani et al. | 62/513 |
| 2007/0000281 | A1 | 1/2007 | Manole | 62/513 |
| 2007/0022777 | A1 | 2/2007 | Takegami et al. | 62/498 |
| 2007/0056312 | A1 | 3/2007 | Kobayashi | 62/335 |
| 2007/0095085 | A1 | 5/2007 | Liu | 62/222 |
| 2007/0125105 | A1 | 6/2007 | Manole | 62/180 |
| 2007/0125106 | A1 | 6/2007 | Ishikawa et al. | 62/183 |
| 2007/0130989 | A1 | 6/2007 | Tsuboi et al. | 62/512 |
| 2007/0144201 | A1 | 6/2007 | Matsumoto et al. | 62/335 |
| 2007/0144206 | A1 | 6/2007 | Tsuboi et al. | 62/470 |
| 2007/0234753 | A1 * | 10/2007 | Nemoto et al. | 62/335 |
| 2008/0223074 | A1 * | 9/2008 | Pachai et al. | 62/513 |

OTHER PUBLICATIONS

H. Renz, "Semi-Hermetic Reciprocating and Screw Compressors for Carbon Dioxide Cascade Systems," 20$^{th}$ International Congress of Refrigeration, 1999, pp. 1-7.

* cited by examiner

CASCADE COOLING SYSTEM WITH INTERCYCLE COOLING OR ADDITIONAL VAPOR CONDENSATION CYCLE

CROSS-REFERENCE TO RELATED APPLICATION

The present application claims priority to U.S. Provisional Application No. 61/126,276, filed on May 2, 2008.

BACKGROUND OF THE DISCLOSURE

1. Field of the Disclosure

The present disclosure relates to cascade cooling systems, and in particular cascade cooling systems having inter-cycle cooling capacity.

2. Description of the Related Art

Cascade cooling systems can comprise a first, or top-side cooling cycle, and a second, or low-side cooling cycle. The two systems interface through a common heat exchanger, i.e. a cascade evaporator—condenser. Cascade cooling systems can be beneficial when there is a need for cooling to very low temperatures. They can also be necessary when equipment that can withstand very high pressures, which are required for the coolants used to provide cooling to these very low temperatures, is not available. There is a continuing need to improve the energy efficiency, system reliability, and safety of these systems.

SUMMARY OF THE DISCLOSURE

The present disclosure addresses these needs with a cascade cooling system that utilizes intercycle cooling, e.g. an intercycle heat exchanger that simultaneously subcools refrigerant leaving the condenser of the top-side cooling cycle, and further heats the vapor leaving the evaporator of the low-side cooling cycle.

DETAILED DESCRIPTION OF THE DISCLOSURE

Figure 1:
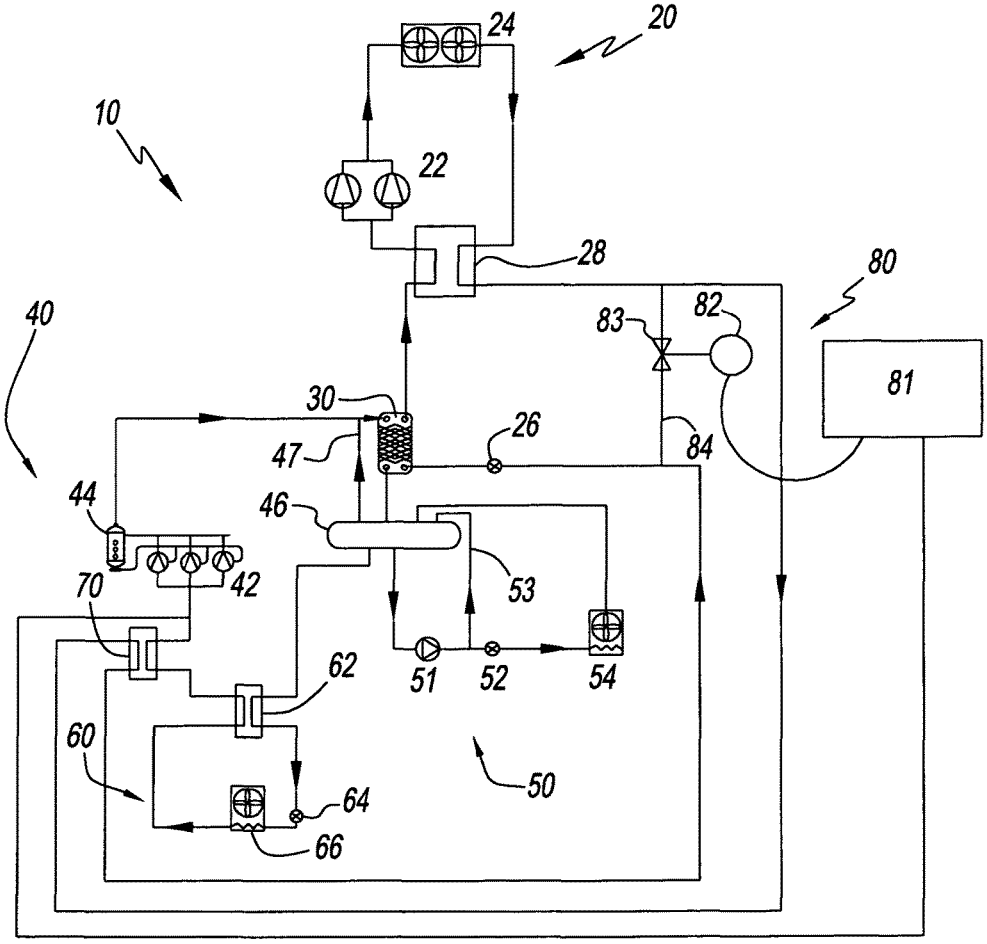
FIG. 1 shows a schematic drawing of the cascade cooling system of the present disclosure.

Referring to FIG. 1, cascade system 10 is shown. Cascade system 10 has top cycle 20, low cycle 40, and intercycle heat exchanger 70. In intercycle heat exchanger 70, a first refrigerant leaving a condenser 24 of top cycle 20 is subcooled by a second refrigerant leaving evaporator 66 of low cycle 40, and the second refrigerant is superheated by the first refrigerant. Intercycle heat exchanger 70 provides a vastly improved efficiency of cascade system 10 over comparative systems currently available, especially when intercycle heat exchanger 70 is used exclusively or in conjunction with additional suction line heat exchangers (SLHXs), in the manner described below.

In some applications, it is desirable to control the amount of superheating completed by intercycle heat exchanger 70, to make sure that it is above a desired level, and because the design parameters of carbon dioxide compressors often require it, for reliability reasons. If not enough superheating is achieved, a designer has to add some sort of external or artificial heater, which will adversely affect the efficiency of the system. Thus, the present disclosure has advantageously provided control system 80 of cascade system 10, which can monitor and regulate the amount of intercycle subcooling performed in cascade system 10, in the manner discussed below. Control system 80 can provide for an easier control of the amount of superheating, when compared to presently available systems.

In top cycle 20, the first refrigerant is compressed to a high pressure and high temperature in compressor 22, and then passes through condenser 24 for a first amount of cooling. The first refrigerant can then pass through a conventional SLHX 28, wherein the first heat exchange takes place, resulting in subcooling of the first refrigerant. An SLHX can be used to provide subcooling or superheating of a refrigerant between a refrigerant exiting a condenser, and the same refrigerant exiting an evaporator, within the same cycle. These SLHXs can improve the efficiency of the overall system.

The subcooled first refrigerant exiting SLHX 28 then passes through the intercycle heat exchanger 70, where it exchanges heat with a second refrigerant in the manner discussed below, and undergoes further amount of cooling. The first refrigerant is then passed through an expansion device 26, where it is expanded to a low-temperature, low-pressure vapor. The first refrigerant is then passed to main heat exchanger 30, where it again exchanges heat with the second refrigerant, in a manner discussed below. The refrigerant can then be returned to compressor 22, thus completing the cycle of top cycle 20.

As discussed above, in one embodiment, top cycle 20 can have SLHX 28. In SLHX 28, the first refrigerant, after being cooled and/or condensed in condenser 24, exchanges heat with the low temperature, low pressure first refrigerant that has passed through main heat exchanger 30, and is being returned to compressor 22. SLHX 28 and intercycle heat exchanger 70 cumulatively improve the efficiency of cascade system 10 in several ways. First, SLHX 28 provides further subcooling of the liquid refrigerant. In some cases, without SLHX 28, flash gas can form, which will decrease the capacity of main heat exchanger 30. Secondly, SLHX 28 can superheat the vapor of the first refrigerant leaving the main heat exchanger 30, thus evaporating remaining liquid, if any, that is in the stream of the first refrigerant. Liquid remaining within the refrigerant stream at this point could possibly damage compressor 22.

The heating and cooling that takes place within SLHX 28 as well as intercycle heat exchanger 70 increases the system refrigerating capacity, with beneficial increases in system efficiency and the coefficient of performance (COP) of the system. The selection and use of an SLHX can be very critical, as the benefits of an increase in refrigerating capacity can be negated by way of excessive sub-cooling, with significant pressure drops, that can adversely affect the system COP.

The first refrigerant circulating in top cycle 20 can be any number of refrigerants. For example, the first refrigerant can be any hydrofluorocarbon (HFC) such as R404A, which is a blend of penta-, tetra-, and trifluoroethane.

Top cycle 20 interfaces with bottom cycle 40 through main heat exchanger 30. At main heat exchanger 30, the first refrigerant circulating through top cycle 20 is evaporated by the second refrigerant passing through bottom cycle 40. At the same time, the second refrigerant is condensed by the first refrigerant.

In bottom cycle 40, the second refrigerant is compressed by compressor 42, and then passes through oil separator 44, which removes any compressor oil that has been carried by the second refrigerant. The second refrigerant then passes through main heat exchanger 30, where, as discussed above, it is condensed by thermal interaction with the first refrigerant. The second refrigerant can then be circulated to a separator 46, whose function is to serve as a reservoir and/or to separate the second refrigerant into vapor and liquid states. The vapor can be returned to main heat exchanger 30 via vapor return line 47.

The liquid portion of the second refrigerant within separator 46 can be routed to one of two locations. For medium-level cooling applications (for example, display cases, dairy cases, meat cases, and deli cases in supermarkets), the second refrigerant can be diverted through a medium temperature circuit 50. Circuit 50 comprises a pump 51, an optional flow control device 52, and an evaporator or series of evaporators 54, which provides cooling to the desired medium. Flow control device 52 can control the second refrigerant so that all or none of the second refrigerant passes to evaporator 54, or any amount in between. Circuit 50 also comprises a bypass line 53. If there is no demand for medium temperature cooling, flow control device 52 operates to terminate the flow of the second refrigerant to evaporator 54, and routes all of the second refrigerant through bypass line 53 back to separator 46. Alternately, to balance the system mass flow (in case the pump capacity is greater than the system requirement), the excess flow is diverted back to the separator through the bypass line 53. The excess pump energy flashes the liquid in the separator 46, thereby generating vapor that is separated and routed to heat exchanger 30 via vapor line 47. Another alternative (not shown), is to route the return from the medium temperature evaporator 54 directly to the heat exchanger 30 instead of returning to the separator 46.

For applications that require a greater degree of cooling (for example, glass door reach-in freezers, open coffin style freezers, frozen food display cases, etc.), the liquid portion of the second refrigerant from separator 46 can be routed to a low temperature circuit 60. Circuit 60 can comprise an optional second SLHX 62, an expansion device 64, and an evaporator 66. The second refrigerant passes through expansion device 64, where it is expanded to a low temperature and low pressure state, and then the liquid undergoes a phase change in the evaporator 66, to provide the desired cooling. SLHX 62 functions in a similar manner to SLHX 28 of top cycle 20, namely that it provides additional cooling and evaporation for the second refrigerant upstream and downstream of evaporator 66, respectively.

In one embodiment, the second refrigerant can be carbon dioxide. However, other candidates for the second refrigerant are considered by the present disclosure, such as ammonia.

Vapor exiting SLHX 62 is then circulated to intercycle heat exchanger 70, where it is in thermal communication with the first refrigerant of top cycle 20. As discussed above, this configuration provides significant benefits for the COP of system 10. As can be seen in the data below, intercycle heat exchanger 70 can provide significantly better performance than standard cascade cooling systems.

Figure 2:
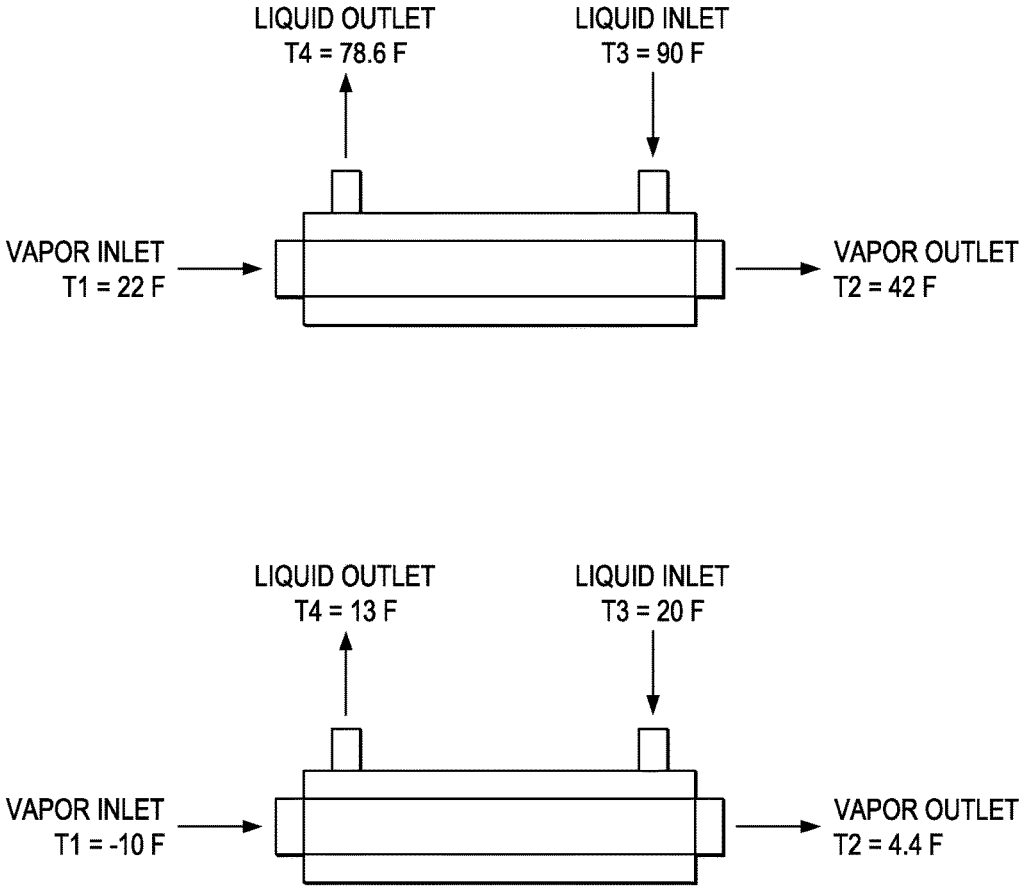
FIG. 2 shows a schematic drawing of the suction line heat exchangers of the system of FIG. 1.
Figure 3:
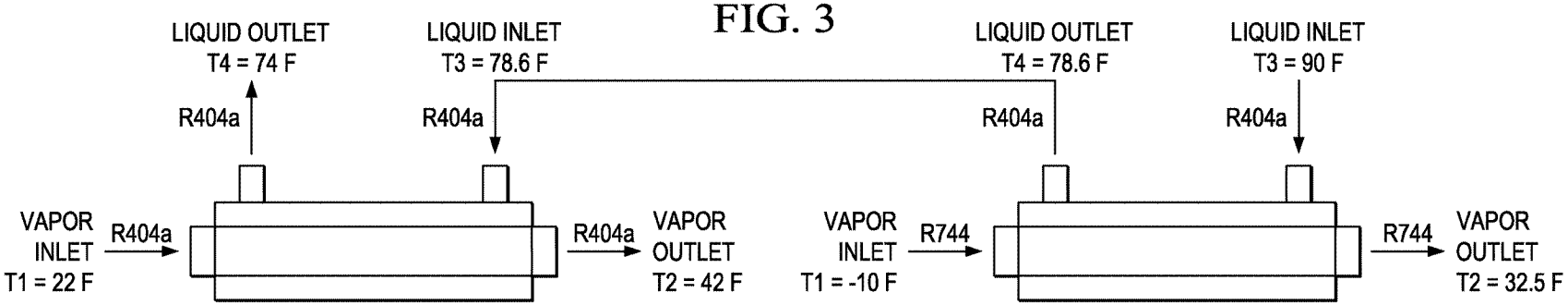
FIG. 3 shows a schematic drawing of the suction line heat exchangers of FIG. 2, when used in conjunction with the intercycle heat exchanger of FIG. 1.

Referring to FIGS. 2-3, the advantages of system 10 (e.g., FIG. 1) of the present disclosure are illustrated more clearly. The temperatures used in FIGS. 2-3 are not meant to be limiting of system 10, but are merely used to show the difference between system 10 and conventional cooling systems. In the HFC (e.g., R-404A) cycle shown in the upper portion of FIG. 2, refrigerant liquid exiting the top cycle condenser 24 (e.g., FIG. 1) at 90° F. (degrees Fahrenheit) exchanges heat with refrigerant vapor exiting the top cycle evaporator 30 at 22° F. In one example, the liquid HFC is subcooled to a temperature of 78.6° F., while the HFC vapor is heated to a temperature of 42° F. In the carbon dioxide (e.g., R744) cycle shown in the lower portion of FIG. 2, refrigerant carbon dioxide exiting the low cycle condenser 30 (e.g., FIG. 1) at 20° F. exchanges heat with the carbon dioxide vapor leaving the low cycle evaporator 66 (e.g., FIG. 1) at −10° F. The R744 may act at a saturation temperature of −15° F., and undergo additional superheating while still disposed within evaporator 66, bringing the temperature to −10° F. In one example, the carbon dioxide liquid is cooled to a temperature of 13° F., while the carbon dioxide vapor is superheated to a temperature of 4.4° F., for a superheat amount of 19.4° F., i.e. from −15° F. to 4.4° F. Even with a heat exchanger having a close to ideal effectiveness of 0.8 (SLHXs such as the one shown in FIG. 2 typically have effectiveness on the order of 0.3), the maximum amount of superheating of the carbon dioxide vapor, attainable without using any external heating device, would be 29° F. This is not enough superheating for many carbon dioxide compressors, which often require superheating of more than 36° F.

Referring to FIG. 3, another configuration of the present disclosure is shown. In this example, a top cycle refrigerant, such as R404A, leaves a condenser, such as condenser 24 (e.g., FIG. 1), at 90° F., and exchanges heat with R404A refrigerant leaving the main heat exchanger 30 at 22° F., within SLHX 28. As with the SLHX shown in FIG. 2, the R404A liquid can be cooled to a temperature of 78.6° F. This liquid can then be circulated through intercycle heat exchanger 70 (e.g., FIG. 1), where it can provide superheating to R744 exiting evaporator 66 (e.g., FIG. 1) or SLHX 62 (e.g., FIG. 1) of low cycle 40 at −10° F. As shown, the amount of superheating provided to the carbon dioxide vapor of the low cycle using intercycle heat exchanger 70 is 47.5° F. (i.e. from −15° F. to 32.5° F.), which is much greater than in the systems of the prior art. Again, this data was calculated at an intercycle heat exchanger efficiency of 0.3. With a close to ideal heat exchanger having an effectiveness of 0.8, the superheating can be as much as 76° F. This number was calculated based on the log mean temperature difference (LMTD) between the two refrigerant streams within and along the length of the heat exchanger.

Figure 4:
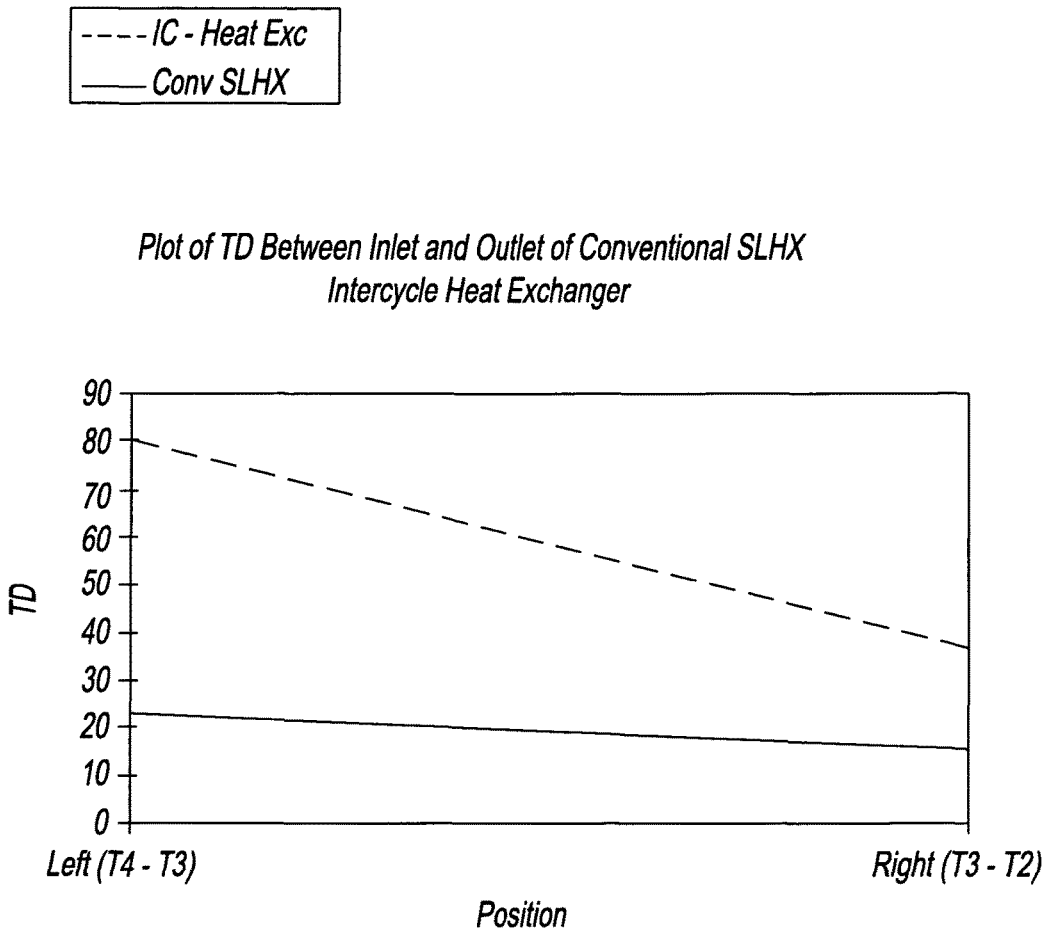
FIG. 4 shows a graph comparing the temperature differences present in the suction line heat exchangers, and the intercycle cooling heat exchanger of the present disclosure.

Referring to FIG. 4, a plot showing the temperature difference along the length of intercycle SLHX 70, as compared to conventional SLHXs, based on the numbers shown in FIGS. 2 and 3, is shown. As can be seen from the graph, the temperature difference along the intercycle heat exchanger 70 is much greater than in conventional SLHXs.

Control system 80 further adds to the efficiency of cascade system 10. As stated above, it is often desirable to maintain the superheating of the second refrigerant above a certain value. A device, such as a controller 81, can measure the temperature of the second refrigerant as it exits intercycle heat exchanger 70, and determine the amount of superheating. Controller 81 can then control a motor 82, which can in turn regulate a flow control device 83. Flow control device 83 is disposed on a bypass line 84. When a greater amount of superheating of the second refrigerant is required, controller 81 can control flow control device 83 so that all, or at least a portion, of the first refrigerant is circulated through intercycle heat exchanger 70.

Alternatively, when there is less demand for superheating of the second refrigerant, flow control device 83 can be controlled so that all, or at least a portion of, the first refrigerant can be circulated directly through bypass line 84 and expansion device 26, without passing through intercycle heat exchanger 70. Intercycle heat exchanger 70 is thereby utilized as needed to maintain superheat within comfortable margins. Thus, control system 80 provides a great deal of flexibility in controlling the amount of superheating that occurs in cascade system 10.

Figure 5:
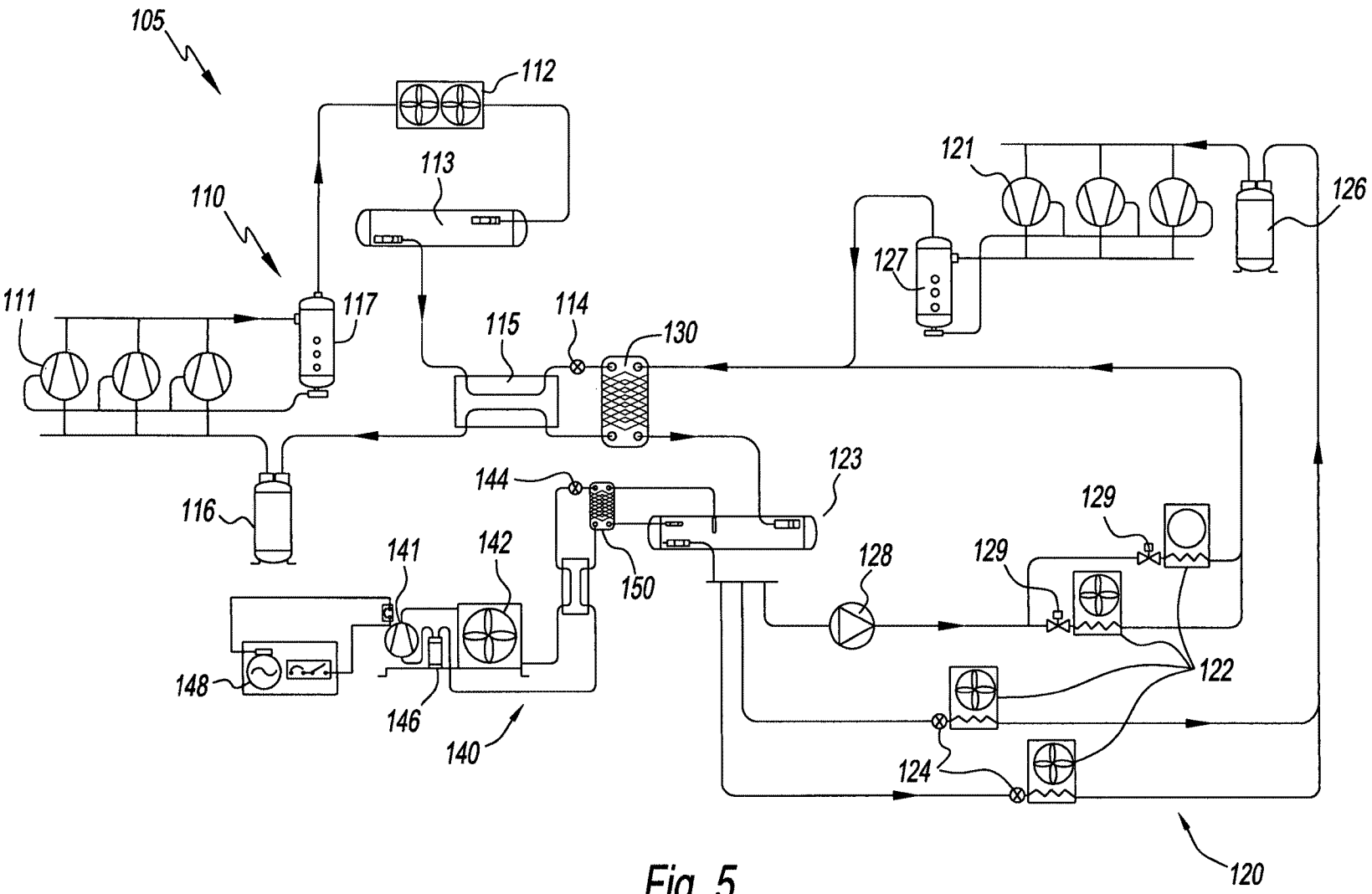
FIG. 5 shows a schematic drawing of a cascade cooling system without intercycle cooling.
Figure 6:
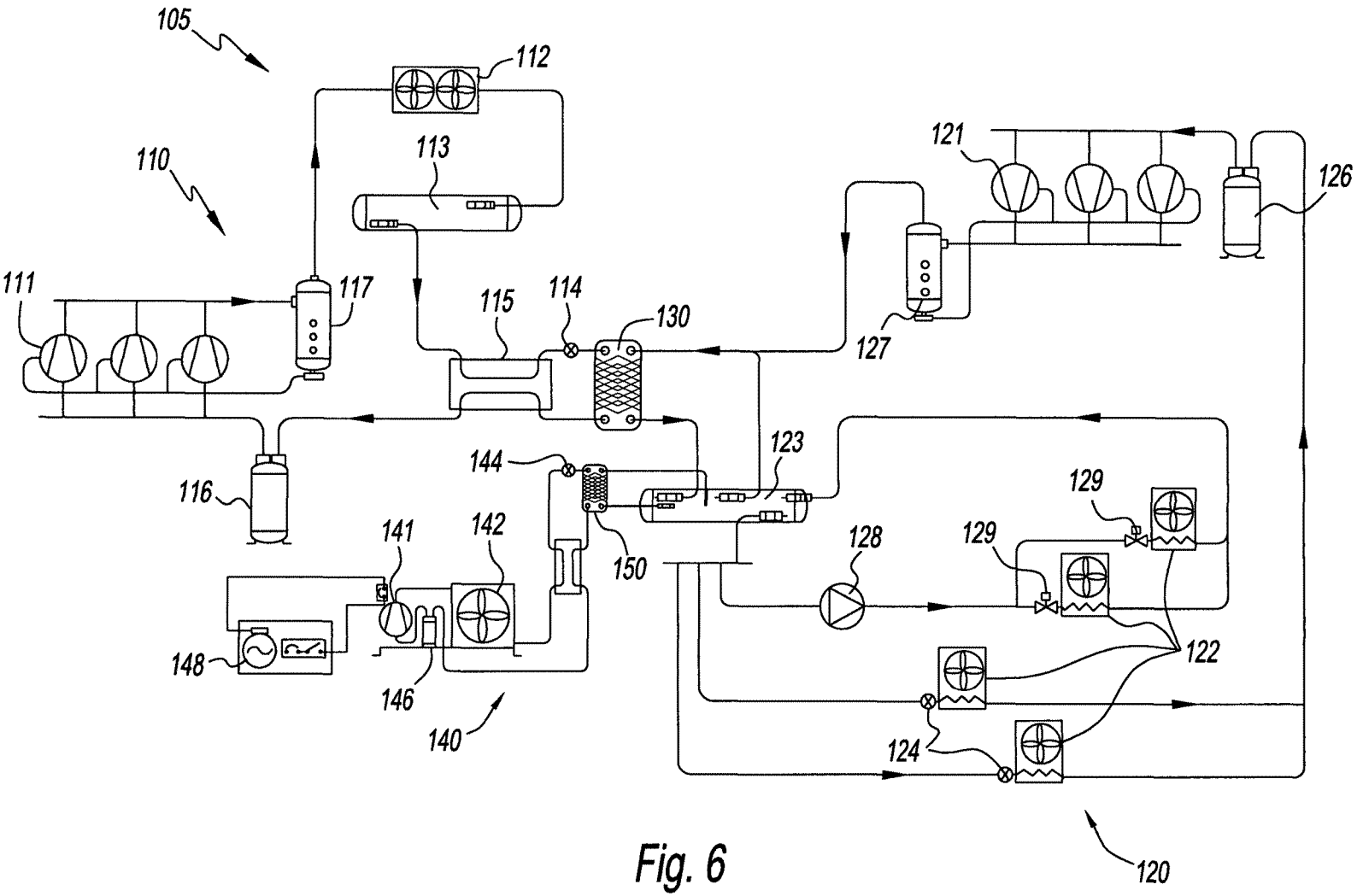
FIG. 6 shows a schematic drawing of a second embodiment of a cascade cooling system without intercycle cooling.

Referring to FIGS. 5-6, another cascade cooling system 105 according to the present disclosure is shown. The system comprises primary system 110, secondary system 120, and evaporator/condenser 130. Cascade cooling system 105 can also have third or emergency system 140.

Primary system 110 comprises compressor 111, condenser 112, receiver 113, and expansion device 114. Refrigerant vapor, i.e. a hydrofluorocarbon (HFC), is compressed by compressor 111 and is discharged as a high pressure, superheated vapor. Oil from compressor 111 that dissolves in the superheated vapor can be removed by separator 117. After the superheated vapor exits compressor 111, it is then condensed to a high pressure liquid by condenser 112. The high pressure liquid is then stored in receiver 113, and is withdrawn as needed to satisfy the load on evaporator/condenser 130. The liquid feed to the evaporator passes through expansion device 114, where the outlet pressure is lower, resulting in "flashing" of the liquid to a liquid/vapor state, which is at a lower pressure and temperature. The refrigerant absorbs heat in evaporator/condenser 130, and, as a result, the remaining liquid is boiled off into a low pressure vapor or gas. The gas then returns back to the inlet of compressor 111, where the compression cycle starts over again. In one embodiment, suction/liquid heat exchanger 115 can be used, to subcool the liquid prior to entering the evaporator, and which utilizes the lower temperature outlet gas of the evaporator to achieve the desired subcooling.

Secondary system 120 comprises compressor 121, receiver 123, one or more evaporators 122, and one or more expansion devices 124. In the shown embodiment, carbon dioxide is used as a refrigerant in secondary system 120. Secondary system 120 follows a similar vapor-compression cycle as that of primary system 110. Vapor is compressed by the compressor 121, and separator 127 can remove any oil that is dissolved in the vapor. The vapor is passed to evaporator/condenser 130, where it is condensed to a high pressure liquid. The liquid is then passed to receiver 123, where it is withdrawn as needed. For a low temperature cycle, this liquid carbon dioxide flows from receiver 123 through one or more expansion devices 124, and into one or more evaporators 122, where it can exchange heat with an environment that requires cooling. The refrigerant exits these low temperature evaporators 122 as a low pressure gas, and is then fed back to compressor 121.

Secondary system 120 also comprises a medium temperature cycle. Liquid exiting receiver 123 can be circulated by pump 128, through one or more flow valves 129 to one or more evaporators 122. Valves 129 can either be open/close valves, or flow regulating valves. The exiting state of the refrigerant in this medium temperature cycle is a high pressure, liquid/vapor mixture. This mixture is then mixed with the vapor exiting compressor 121, and is routed to evaporator/condenser 130, where the vapor is condensed out of the mixture.

Accumulators 116 and 126 help to ensure that liquid does not reach the compressors. Whether or not they are necessary will depend on the particular parameters of the user's system.

The use of third system 140 will depend upon the particular parameters of the user's system, and how emergency power is supplied in a particular application of system 105. Much like primary system 110 and secondary system 120, third system 140 can comprise a compressor 141, condenser 142, and expansion device 144. Third system 140 will maintain the temperature/pressure of the carbon dioxide liquid below a relief setting, that is set to release carbon dioxide to the atmosphere when the pressure becomes too great for second system 120 to withstand. This can happen, for example, during a power failure, and results in loss of carbon dioxide refrigerant, and cooling ability when the system is back on-line. Thus, third cooling system 140 can cool a vapor carbon dioxide within receiver 123 by heat exchange through emergency condenser/evaporator 150. Third cooling system 140 can also have its own power supply 148.

Referring to FIG. 6, a second embodiment of cascade system 105 is shown. This system is identical to that of FIG. 5, with the exception that the liquid/gas carbon dioxide mixture exiting evaporators 122 of the medium temperature cycle is diverted to receiver 123, where the liquid and vapor will separate. The vapor portion will be piped back to the evaporator/condenser 130 through a thermal siphon, and mixed with the vapor exiting compressor 121, in order to condense the vapor to a liquid.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure, but that the disclosure will include all embodiments falling within the scope of the claims.

What is claimed is:

1. A refrigeration system, comprising:

a first cycle for circulating a first refrigerant, said first cycle including:

a first compressor configured to compress a low-pressure vapor form of said first refrigerant into a superheated vapor form of said first refrigerant, a first condenser configured to condense said superheated vapor form of said first refrigerant into a high-pressure liquid form of said first refrigerant, a first receiver connected by refrigeration lines to said first condenser and a first evaporator, the first receiver to receive said high-pressure liquid form of said first refrigerant from said first condenser, and store said high-pressure liquid form of said first refrigerant therein, and a first expansion device configured to expand said high-pressure liquid form of said first refrigerant from said first receiver into a flashed liquid-vapor form of said first refrigerant;

a second cycle for circulating a second refrigerant, said second cycle including:

a second receiver spaced apart from and connected by refrigeration lines to a heat-exchanger to receive a high-pressure liquid form of said second refrigerant and to store said high-pressure liquid form of said second refrigerant therein;

at least one second expansion device fluidically coupled to said second receiver and positioned about a first refrigeration line, said second expansion device configured to expand said high-pressure liquid form of said second refrigerant from said second receiver into a flashed liquid-vapor form of said second refrigerant, wherein the expansion device is directly connected to the second receiver by the first refrigeration line, and the first refrigeration line does not comprise a pump;

at least one second evaporator fluidically coupled to said at least one second expansion device by said first refrigeration line, said second evaporator configured to receive said flashed liquid-vapor form of said second refrigerant from one of said second expansion device such that said flashed liquid-vapor form of said second refrigerant absorbs heat from an environment being cooled by said refrigeration system and is transformed into a gaseous low-pressure form of said second refrigerant;

a second compressor configured to receive said gaseous low-pressure form of said second refrigerant from said second evaporator and compress said gaseous low-pressure form of said second refrigerant into a compressed-vapor form of said second refrigerant; and at least one third evaporator fluidically coupled to said second receiver and positioned about a second refrigeration line, the second refrigeration line in parallel with the first refrigeration line;

a flow regulating valve positioned about the second refrigeration line;

a first pump positioned about the second refrigeration line, the pump positioned between the second receiver and at least one third evaporator;

wherein said heat exchanger is connected by refrigeration lines to receive said flashed liquid-vapor form of said first refrigerant from said first expansion device and to receive said compressed-vapor form of said second refrigerant from said second compressor, wherein said first refrigerant and said second refrigerant are in thermal communication within said heat exchanger so that heat is transferred from said second refrigerant to said first refrigerant thereby converting said flashed liquid-vapor form of said first refrigerant into said low-pressure vapor form of said first refrigerant, and converting said compressed vapor form of said second refrigerant to said high-pressure liquid form of said second refrigerant.

2. The refrigeration system of claim 1, further comprising a third cycle in fluid communication with said second receiver, and configured to exchange heat with a vapor portion of said second refrigerant being stored in said second receiver.

3. The refrigeration system of claim 1, further including:

a first separator configured to receive said super-heated vapor form of said first refrigerant and oil from said first compressor and to deliver said super-heated vapor form of said first refrigerant to said first condenser; and a second separator configured to receive said compressed-vapor form of said second refrigerant and other oil from said second compressor and deliver said compressed-vapor form of said second refrigerant to said heat exchanger.

4. The refrigeration system of claim 1, further including:

a first accumulator configured to receive said low-pressure vapor form of said first refrigerant from said heat exchange and prevent a liquid form of said first refrigerant from reaching said first compressor; and a second accumulator configured to receive said gaseous low-pressure form of said second refrigerant from said second evaporator and prevent a liquid form of said second refrigerant from reaching said second compressor.

5. The refrigeration system of claim 1, further including a suction-line heat exchanger configured to exchange heat from said high-pressure liquid form of said first refrigerant to said low-pressure vapor form of said first refrigerant, prior to said high-pressure liquid form of said first refrigerant entering said heat exchanger of the second cycle.

6. The refrigeration system of claim 5, wherein said suction-line heat exchanger is placed in said system such that said heat exchange in said suction-line heat exchanger occurs prior to said high-pressure liquid form of said first refrigerant entering said first expansion device.

7. The refrigeration system of claim 1, wherein said second refrigerant directed from said at least one third evaporator is mixed with said compressed-vapor form of said second refrigerant before entering said heat exchanger.

8. A refrigeration system, comprising:

a heat exchanger;

a single receiver; wherein the receiver is spaced apart from and connected to the heat exchanger by a fluid line, the receiver in fluid communication with a low temperature evaporator via a first refrigeration line and the receiver in fluid communication with a first medium-temperature evaporator via a second refrigeration line, the second refrigeration line connected to the receiver in parallel with the first refrigeration line, such that refrigerant from the receiver is directed towards the low temperature evaporator via the first refrigeration line and to the first medium-temperature evaporator via the second refrigeration line;

an expansion device positioned about the first refrigeration line and directly connected to the low temperature evaporator and the receiver, wherein refrigerant in the first refrigeration line does not pass through a pump when flowing from the receiver to the low temperature evaporator a compressor fluidically coupled to the low temperature evaporator;

a first pump positioned about the second refrigeration line in between the first medium-temperature evaporator and the receiver; and a flow regulating valve positioned about the second refrigeration line in between the pump and the first medium-temperature evaporator, wherein the flow regulating valve is configured to receive refrigerant from the receiver and direct the refrigerant to the first medium-temperature evaporator, and to the heat exchanger, without passing through the compressor before reaching the heat exchanger.

9. The refrigeration system of claim 8, further comprising:

a second medium-temperature evaporator connected to the pump in parallel with the first medium-temperature evaporator on the second refrigeration line, such that output from the second medium temperature evaporator merges with output from the first medium-temperature evaporator and is directed to the heat exchanger without passing through the compressor before reaching the heat exchanger.

* * * * *